US007921840B2

(12) United States Patent
Oleynik et al.

(10) Patent No.: US 7,921,840 B2
(45) Date of Patent: Apr. 12, 2011

(54) METHOD AND APPARATUS FOR LAUNCHING SOLID BODY AND MULTIPLE SOLID BODIES USING COMPRESSED GAS

(75) Inventors: Vladislav Oleynik, Pittsboro, NC (US); Gennadiy Albul, Pittsboro, NC (US)

(73) Assignee: Umbrella Technologies, Inc., Pittsboro, NC (US)

( * ) Notice: Subject to any disclaimer, the term of this patent is extended or adjusted under 35 U.S.C. 154(b) by 51 days.

(21) Appl. No.: 12/564,782

(22) Filed: Sep. 22, 2009

(65) Prior Publication Data

US 2010/0078004 A1 Apr. 1, 2010

Related U.S. Application Data

(60) Provisional application No. 61/194,003, filed on Sep. 24, 2008.

(51) Int. Cl.

| | |
|---|---|
| ***F41B 11/00*** | (2006.01) |
| ***F42B 12/00*** | (2006.01) |
| ***F42B 14/00*** | (2006.01) |
| ***F42B 10/00*** | (2006.01) |

(52) U.S. Cl. ..... 124/73

(58) Field of Classification Search ..... 124/69–73; 102/501–502; 89/1.11; 244/3.24

See application file for complete search history.

(56) References Cited

U.S. PATENT DOCUMENTS

| | | | | |
|---|---|---|---|---|
| 2,296,834 | A * | 9/1942 | Boynton | 124/75 |
| 3,167,061 | A * | 1/1965 | Murray | 124/60 |
| 4,771,757 | A * | 9/1988 | Chevalier | 124/51.1 |
| 5,909,000 | A * | 6/1999 | Rakov | 89/7 |
| 7,708,002 | B2 * | 5/2010 | Gerardo | 124/73 |
| 2005/0183711 | A1 * | 8/2005 | Eichner et al. | 124/73 |
| 2007/0193569 | A1 * | 8/2007 | Ho et al. | 124/80 |
| 2008/0099004 | A1 * | 5/2008 | Gerardo | 124/73 |

* cited by examiner

*Primary Examiner* — Troy Chambers

(57) ABSTRACT

An apparatus for launching projectiles may incorporate a hermetically sealed launch tube, projectile or projectiles within the launch tube with their payload inside or connected via meaning of socket to projectile from outside. The space between the outer surface of the projectile inside the launch tube and the inner surface of the launch tube is filled with compressed gas and hermetically sealed with a fast removable lid. If outside payload is used, then it will be attached to inside projectile via a socket where inside projectile is located inside the launch tube and outside payload connected to the protruded via fast acting valve, portion of projectile and connected to it via the socket. Projectile may incorporate another meaning of control via controllable surfaces or propulsion or constant acting engines. The exhaust gas would be in addition to use for projectile stabilization or additional propulsion, by incorporation a exhaust gas organizers.

13 Claims, 5 Drawing Sheets

METHOD AND APPARATUS FOR LAUNCHING SOLID BODY AND MULTIPLE SOLID BODIES USING COMPRESSED GAS

TECHNICAL FIELD

This invention relates to the physics of object motion/projection, gas dynamics, pneumatic transportation, and compressed gas propulsion and artillery. The theme of this invention is the integration of these subjects in practical applications.

BACKGROUND

Initial evidence of this physical principle occurred in nature and mechanical apparatuses where is compressed gas is used for moving and promote the projectiles. For the basic understanding, a pneumatic gun mechanism could be used for initial explanation of the phenomena of propulsion of the projectile.

BRIEF SUMMARY

But instead a sudden valve open behind the projected object and pushing the projectile like a piston, in present invention used a phenomena of compressed gas expansion under sudden open of front valve and appearance of the front moving shockwave and depression wave propagated in opposite direction of projectile. Propagated in forward shockwave create an aerodynamic stable pathway for promote projectile movement in stationary air without air resistance or partial air resistance. Propagated wave of depression in opposite direction from projectile, inside the launch tube, generate an additional force of promotion of the projectile.

Conducted experiments have shown the feasibility of launching solid bodies by means of compressed gas and specially designed launching tubes and fast removed lid or fast acting valve on one end of the launch tube where another end was sealed. Experiments shown, launch tube could be, but not limited to, any shape, include and not limited to circular, round, elliptical, square or rectangular.

Practical applications of a newly discovered physical principle are presented. Masses of stored molecules of air stored under pressure in initial moment, and after sudden opening of the fast acting valve will apply pressure against the projectile and develop a backward moving discharge depression wave and forward moving propagated shockwave, which appear by meaning of energy stored in the compressed gas, to move forward projectile.

DETAILED DESCRIPTION

Introduction

A newly discovered physical principle and emerging methods for utilizing this principle are presented.

Initial evidence of this physical principle very well known in practice of mechanic and has been utilized in variety of different applications in past and modern world. Even a brief mentioned of the pneumatic gun, will reveal a simple principle of expanding gas on one end of the projectile and developing force to perpetuate the projectile by meaning the expanding gas and projectile acting as a piston in cylinder of the gun barrel. On another part the well known phenomena, where principle reveals itself as sudden eruptions of earth material, rock, debris, their mix, water and compressed gas emanating from mine entrances, where is main force of moving objects is delivered by compressed gas with a distributed ultrasound wave propagated from the surface of the discharge layer to the center of compressed gas volume, which delivery an enormous speed to the flying objects and debris. The rate of this phenomenon can be devastating, with thousands of tons of rock and over one million cubic feet of gas moving long distances at great velocity through mine tunnels.

At same time, the compressed gas charge, applied in one end of the projectile, make a projectile to move, but a projectile will move in the atmospheric pressure at own front, and will develop a significant air resistance proportion to speed and other parameters. Newly discovered phenomena, at same time, make a sound wave discharge propagated in same direction as a moving projectile, work in positive way and create favorable conditions for the acceleration and move through surrounding air.

The underlying science for this natural phenomenon has not yet been fully documented. However, it is known those ultrasonic discharge waves are propagated in the compressed gas volume, resulting in dramatic propulsion energy transfers to the projectile(s). Technological means of practically applying for launching projectile has been under recent studding by authors and the underlying principle have been demonstrated and are described below.

Principles of Operation

Figure 1:
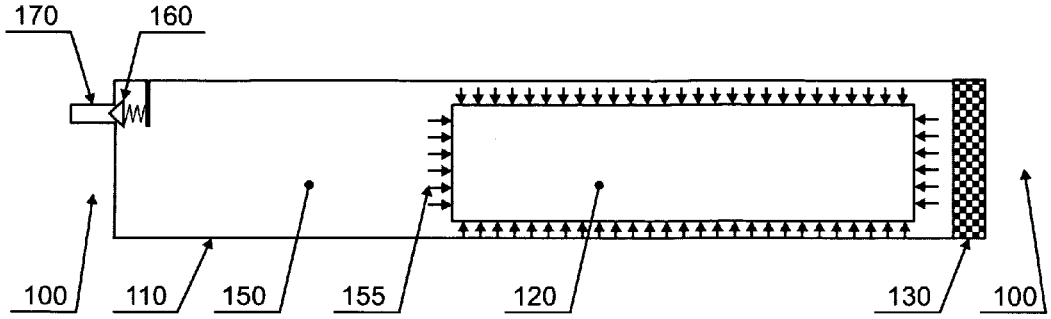
FIG. 1 A launch tube with projectile inserted inside with fast acting valve. It is initial configuration after assembling and/or charged.

A launch tube with projectile inserted inside with fast acting valve is shown in FIG. 1. Prior to launch, the projectile (120, FIG. 1) is located inside the launch tube (110, FIG. 1). The volume between the inner surface of the launch tube and the outer surface of the inserted projectile is filled with compressed gas (150, FIG. 1) with pressure Plt is introduced through the gas inlet (170, FIG. 1) with reverse flow valve (160, FIG. 1) shown only on FIG. 1 for clarity purpose. Ambient pressure Pam (100, FIG. 1) present in surrounding space, outside of the launch tube. The compressed gas resides in the space (150, FIG. 17), inside a launch tube. The compressed gas requires no special preparation such as heating, cooling, or control of moisture content; air taken directly from the surrounding environment can be used; or compressed gas from the tank could be used; or other meaning of compressed gas could be used. For instance, to increasing the maximum pressure, without using a multistage compressors or big quantity of tanks with compressed gas, after filling with compressed air, volume (150, FIG. 1) could be heated to reach a significantly higher initial pressure. The launch tube exit equipped with a fast removed lid or fast acting valve (130, FIG. 1) sealed in initial moment.

Figure 2:
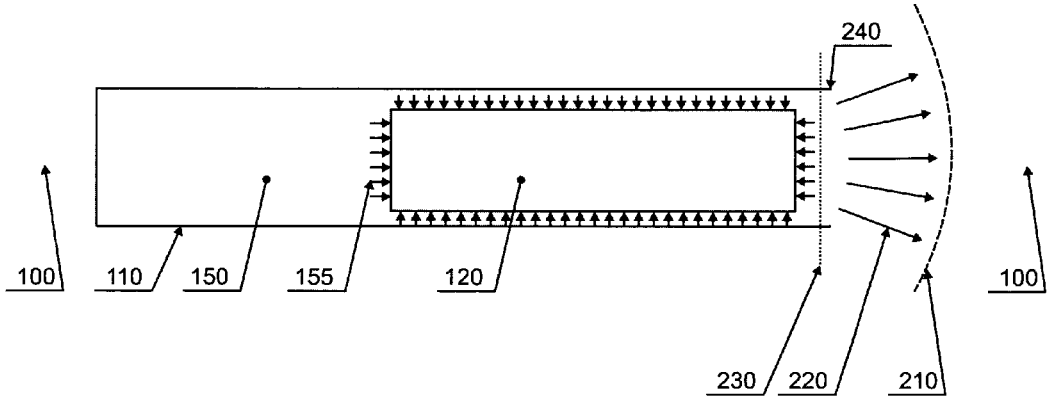
FIG. 2 Launch of the projectile is initiated with the sudden removal of the fast acting valve.

Launch of the projectile is initiated with the sudden removal of the fast acting valve (130, FIG. 1). This valve has a special design to comprehend a fast removing action of the lid. After fast acting valve (130, FIG. 1), is open (FIG. 2), a shock wave (210, FIG. 2), resulting from the escaping of compressed gas (220, FIG. 2) from the launch tube (110, FIG. 2) opening (240, FIG. 2). A discharge gradient wave, or depression wave (230, FIG. 2), will be formed and will start to propagate from the launch tube exit (240, FIG. 2) toward the bottom of the projectile (120, FIG. 2) and further down to the bottom of the launch tube (110, FIG. 2). The shock wave (210, FIG. 2) will be accompanied by a stream of gas (220, FIG. 2) moving in the same direction with the projectile (120, FIG. 2), leaving through the launch tube exit (240, FIG. 2) into ambient space (100, FIG. 2).

Figure 3:
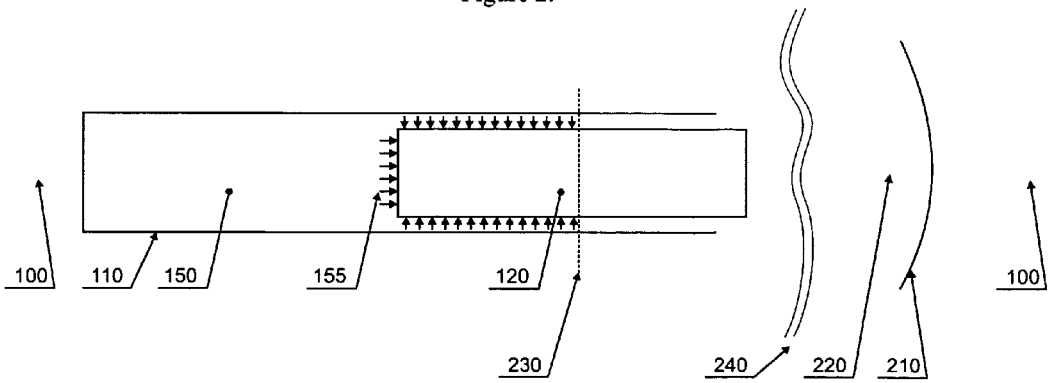
FIG. 3 Further development of the launching process in progress.
Figure 4:
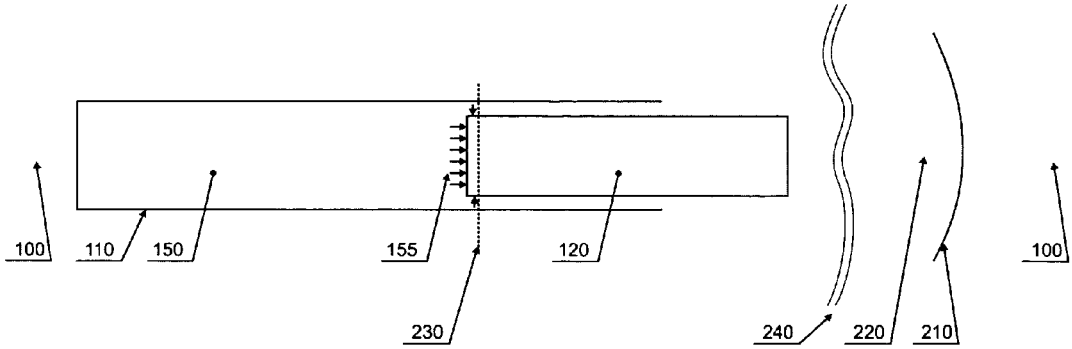
FIG. 4 Development of process of launching when projectile is further advanced to the launch tube exit.

A depression wave (230, FIG. 3) propagates through the launch tube in the opposite direction of the shock wave (210, FIG. 3). While the depression wave boundary propagates over the projectile, the pressure differential between PLT (150, FIG. 3) and PAM (100, FIG. 3) results in the projectile gaining momentum. The projectile begins to move in the direction opposite to the direction of the depression wave (230, FIG. 3), towards the open end of the launch tube (240, FIG. 3) and at same direction shock wave (210, FIG. 3) is moving. The time to accumulate energy of the impulse by the projectile (120, FIG. 3) inside the launch tube (110, FIG. 3) is relatively long because the propagation velocity of the depression wave (230, FIG. 3) in the gradient of compressed and non compressed gas and in comparison to propagation velocity on the open air pressure is higher. When the projectile (120, FIG. 3) leaves the launch tube (110, FIG. 3) it will continue travel in relatively compressed and propagated in same direction exhaust compressed air. And the projectile (120, FIG. 3) will not encounter resistance of ambient space air because the shock wave (210, FIG. 3) propagated in front of escaping compressed gas wave are accelerating the air in ambient space. This factor significantly lowers air resistance force encountered by the projectile during the first stage of ballistics fly outside the launch tube (110, FIG. 3). The depression wave velocity corresponds to the velocity of sound in the boundary of compressed air.

Figure 5:
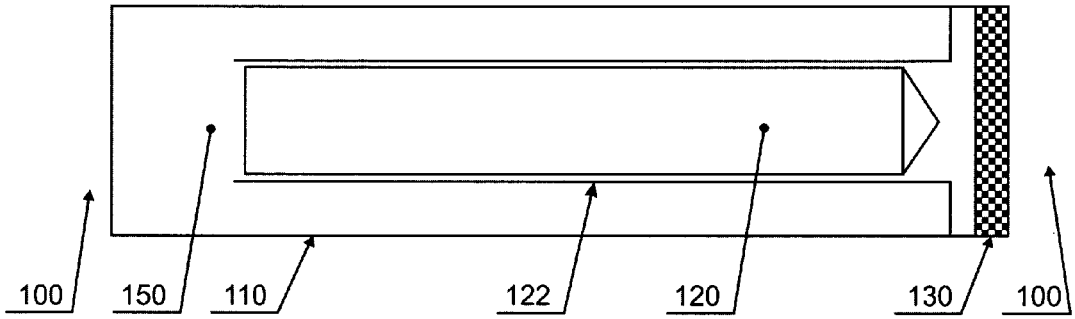
FIG. 5 Possible practical use of single stage system with more detailed explanation of implementation.

The apparatus could be built in single, dual triple or more stages. Basically more effective could be considered two or more stage systems. On FIG. 5 presented a single stage system with more detailed explanation of implementation of inner tube (122, FIG. 5) for launch tube (110, FIG. 5). For clarity launching inner tube (122, FIG. 5) and the projectile (120, FIG. 5) depicted in different linear dimensions, but in practice, it could be executed with a same, smaller or slightly bigger dimension proportions, if consider a equal gas volume proportion. Where is projectile (120, FIG. 7) and fast acting valve (130, FIG. 1) remain same as it was described above.

Figure 6:
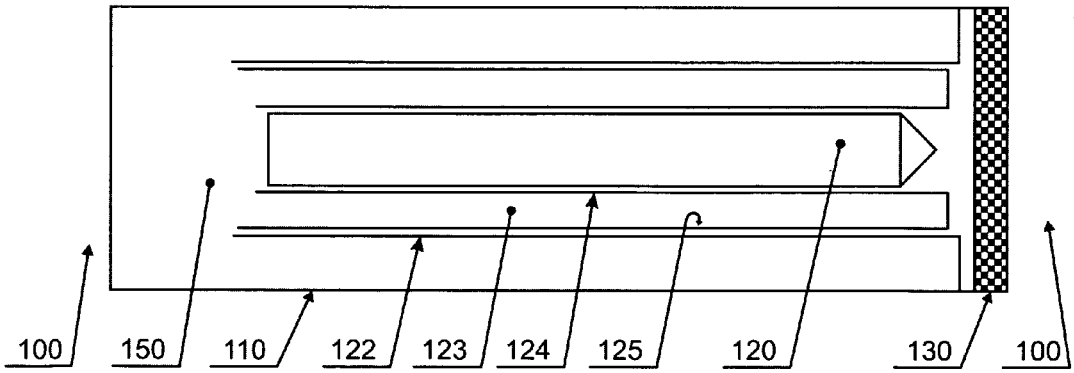
FIG. 6 A dual stage system

A dual stage system presented on FIG. 6. First stage operated as it has been described above, but a second stage (123, FIG. 6) with the outer tube (125, FIG. 6) and inner tube (124, FIG. 6) forming a separate from a first stage volume, which is concentrically displaced inside the first stage inner tube (122, FIG. 6). Similar to FIG. 5, on FIG. 6 first stage and second stages depicted slightly smaller only for clarity reason. In practice it could be smaller or equal or bigger, or sized according to equal gas volume proportion linear and diameter proportions, as it is call in design. Where is projectile (120, FIG. 7) and fast acting valve (130, FIG. 1) remain same as it was described above.

Figure 7:
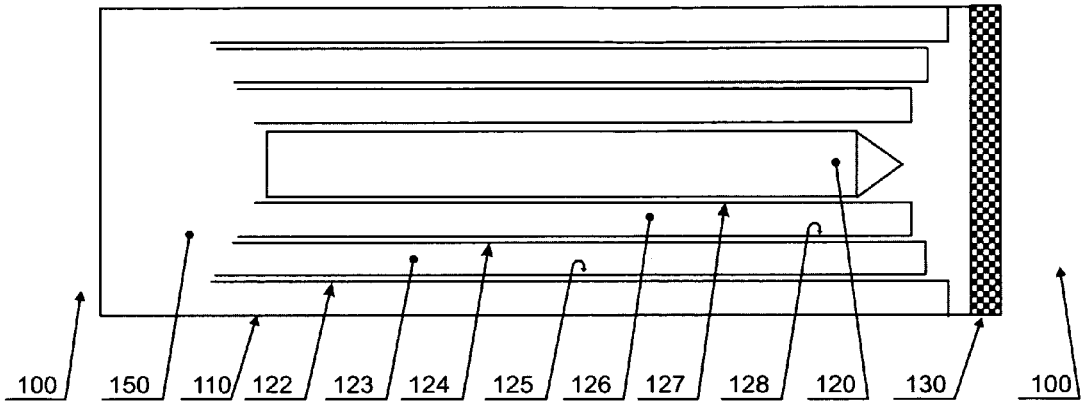
FIG. 7 A three stage system

Next, but not last, iteration form dual stage system could be a tree stage system depicted on FIG. 7. To above described first stage inner tube (122, FIG. 7) added a second stage (123, FIG. 7) with inner (124, FIG. 7) and outer tubes (125, FIG. 7), and third stage (126, FIG. 7) with inner tube (127, FIG. 7) and outer tube (128, FIG. 7). Where is projectile (120, FIG. 7) and fast acting valve (130, FIG. 1) remain same as it was described above.

Figure 8:
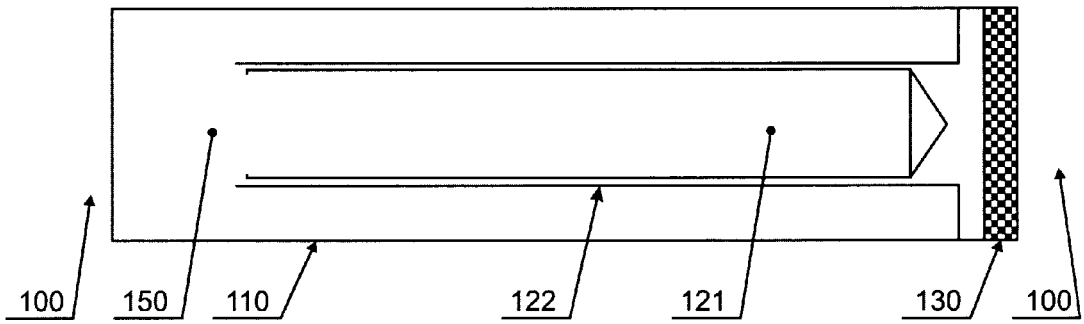
FIG. 8 A hollow body projectile example

All above design could be use a hollow body projectile (FIG. 8) along with a solid body projectile. Hollow body projectile (121, FIG. 8) it is one step forward to make a multiple stage system, without introducing an additional stage element such as described above and increase a complexity of the design.

Figure 14:
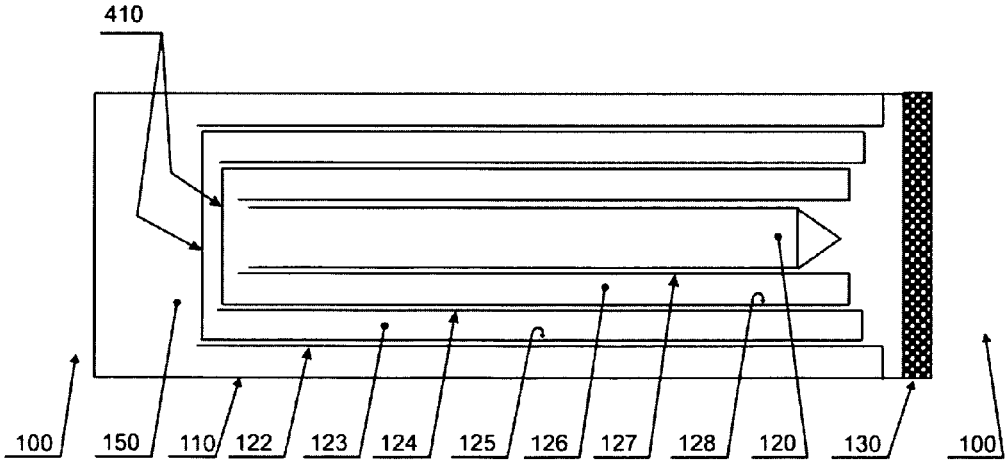
FIG. 14 Bottom covers is depicted on multiple stage system

As a further logical step to improve the outcome, would be introduction to the sealed stages, which is depicted on FIG. 14. Second stage (123, FIG. 14) has an bottom wall (410, FIG. 14), and third stage (126, FIG. 14), has an bottom wall (410, FIG. 14). Between stages could be used a valves, orifices or pressure reduction elements, which would provide a separation during launch and controllable final pressure.

Figure 9:
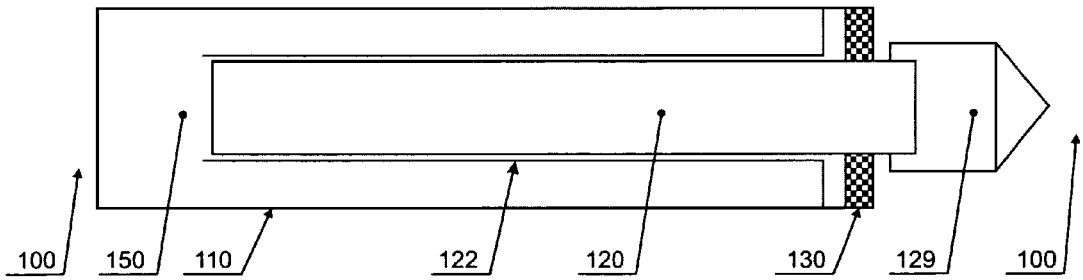
FIG. 9 An outside payload design presented with use of protruded fast acting valve.

Instead using an solid body or hollow body projectile with all payload located inside the launch tube, proposed invention could simple accommodate the protruded fast acting valve design, where the projectile protruding the fast acting valve and take an payload volume (129, FIG. 9) outside the high gas pressure environment. Or similar design could be applicable for the projectile socket for the payload allocation totally outside the launch tube and connection to the projectile via a meaning of socket. A similar or exact design could be easily accommodated by specialist, familiar with art.

Figure 10:
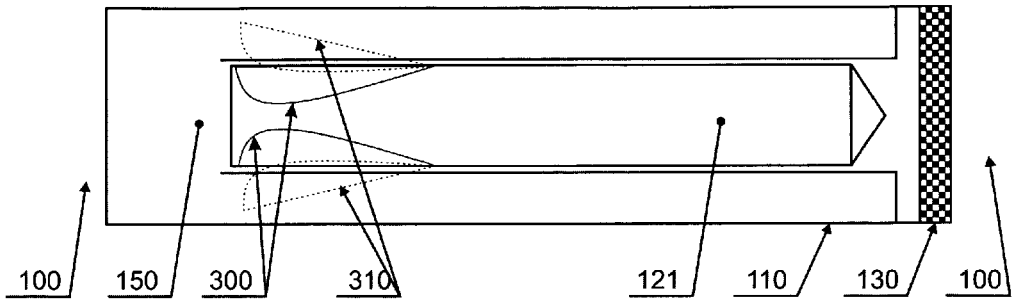
FIG. 10 An solution for foldable stabilizers is depicted.

If it is desirable to have an stabilizers or controllable stabilizers, they could be implemented as a hidden surfaces (300, FIG. 10) in pre-launch position and spring or another mechanism meaning for opening after launch (310, FIG. 10).

Figure 11:
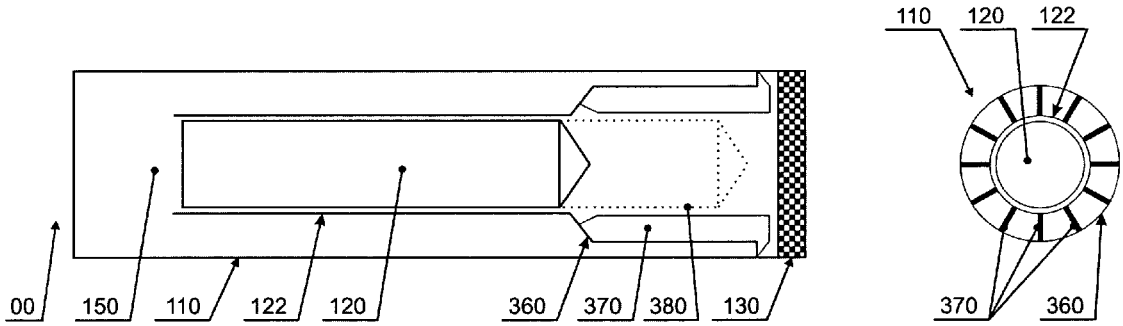
FIG. 11 Exhaust flow gas stabilization fins is depicted in combination with modified inner tube of launch tube.

As another measure of the meaning of stabilization, would be incorporation of devices for forming exhausting air stream on the stationary equipment, such as launch tube or on the surrounding equipment. One of, but not limited to, attempt, depicted on the FIG. 11. An modified version of inner tube (360, FIG. 11) and a number fins (370, FIG. 11) presented. A quantity of the fins and their configuration could be different, dependent on the specific technical requirements. In one instance, but not limited to, it could be a quantity of radial fins (370, FIG. 11) forming a straight stream of air. Or on another instance, but not limited, same fins could form a one directional spiral exhaust air stream. Also, for another example, but not limited, it could be a number of fins oriented in opposite direction and incorporated number of holes, to form the turbulent flow in exhaust flow. A person, familiar with art, would without difficulties draw proposed design. The projectile (120, FIG. 11) position is depicted on FIG. 11, but not limited to, could be loaded with offset to the bottom of the inner tube launch tube or just made a same length (dotted line, 380, FIG. 11) as required per design specifications.

Figure 13:
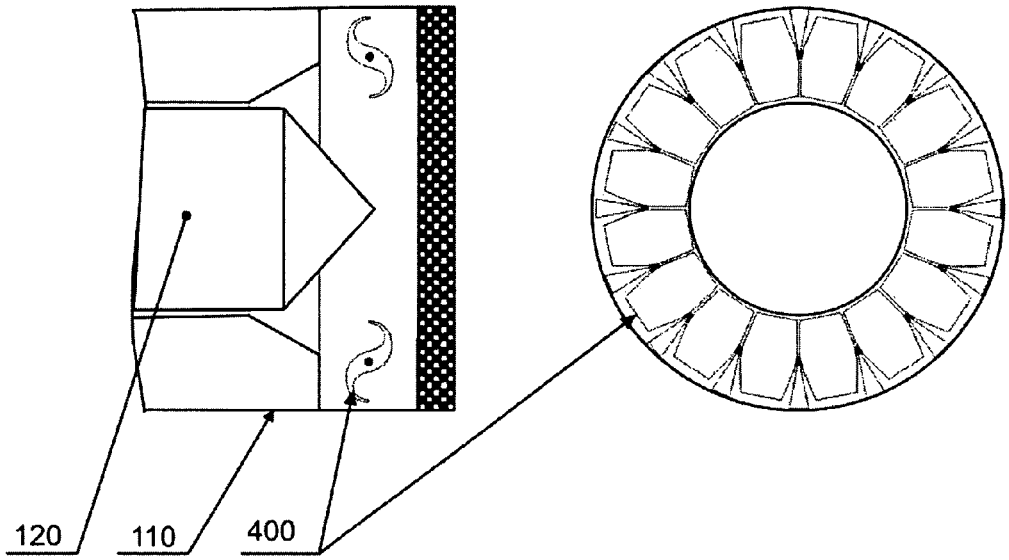
FIG. 13 Depicted a possible tabulator configuration

In addition to the process of urbanization by long stationary fins (370, FIG. 11) in variety of configurations, or instead of using a linear fins (370, FIG. 11), would be installed a rotating turbulators depicted on the FIG. 13. All rotary turbulators (400, FIG. 13), are connected to each other via meaning of flexible cable, and all they rotating synchronously to convert gas stream to a puff charges, produce the two puff, for each time they rotated one time. This device, which depicted on FIG. 13, one of many possible example, of vortex generators. A rotary turbulators (400, FIG. 13) shown on the picture in simplified form, to provide clarity to the invention.

Figure 12:
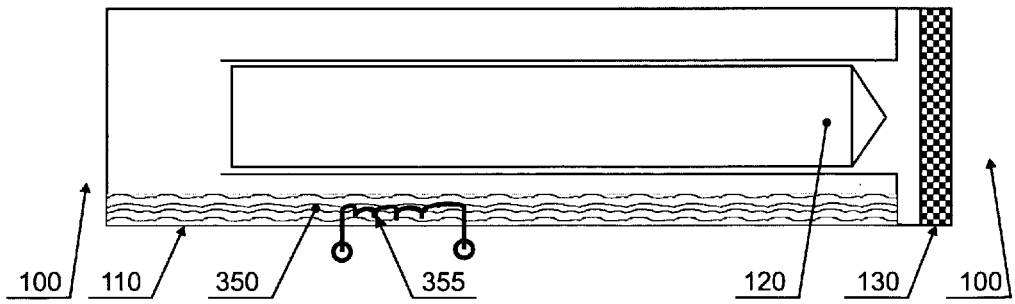
FIG. 12 Depicted an effect of expanding liquids under applied heat to help increase inner pressure.

An effect of expanding liquids (350, FIG. 12) under applying heat (355, FIG. 12), could be utilized for the increasing internal pressure inside the launch tube before launching. Meaning of the nomenclature of liquids for usage could be as wide as and investigator could be find applicable, from the simple water to a complex chemical compositions for introduce long time storage and preservations properties. For instance, one of possibilities, but not limited to, could be used alcohol since it is require a relatively low volume of heating for given volume. A heater could be any meaning of a source of outside energy, include, but not limited, to electric filament, heat pipe, or a simple external source of open fire. In one instance, a liquid could occupied a whole volume of the launch tube and could be used a multiple heating elements. Or on another application, instead of electric heating elements, could be used a heat produced by thermonuclear station or another meaning of excessive heat.

Expanding, towards to multiple stages would be a simple execution for observer familiar with the nature of the art. And practical design details, such as dimensions, materials, thickness, etc., may wary, dependent on project requirements, experience and specific details of the implementation. Particularly this innovation is not limited to scalability or dimensions and could upsized or downsized as desired.

Also, need to be underlined, a possible system design configuration is limited only to available materials and skills, and the production capacities of the manufacturing facilities. For instance, instead using a cylindrical design, all could be executed in the square or elliptical shaped tubes so could be called by specific application requirements.

What is claimed is:

1. An apparatus for launching projectiles, comprising:

a hermetically sealed launch tube comprising an inner volume filled with compressed gas;

a projectile within the launch tube, wherein the compressed gas applies a pressure to a sealed end of the launch tube and a portion of the projectile; and a fast acting frontal valve located at a launch tube exit of the hermetically sealed launch tube, wherein sudden removal of the fast acting frontal valve causes the projective to launch from the hermetically sealed launch tube.

2. The apparatus for launching projectiles of claim 1, wherein the projectile comprises multiple projectiles.

3. The apparatus for launching projectiles of claim 1, wherein the projectile comprises a payload located in a hermetically sealed pocket of a head portion of the projectile.

4. The apparatus for launching projectiles of claim 1, wherein the hermetically sealed launch tube comprises at least two stages with an open bottom wall for each stage, wherein each stage acts independently and serially.

5. The apparatus for launching projectiles of claim 1, wherein the hermetically sealed launch tube comprises at least two stages, wherein a bottom wall of each of the at least two stages is sealed, and at least one of a valve, an orifice, and a pressure regulator allows pressure in each stage to be maintained separately.

6. The apparatus for launching projectiles of claim 1 further comprising an object attached to an end of the projectile by an attachment media comprising one of a rope, and a chain cable; wherein one end of the attachment media is attached to the end of the projectile and another end of the attachment media is attached to the object, whereby the object is flown in a direction of the projectile.

7. The apparatus for launching projectiles of claim 1, wherein the fast acting frontal valve comprises a self-destructible valve that self destructs by at least one applied pressure charged compressed gas and applied mechanical pressure; wherein a launch process starts upon compressed gas filling the inner volume of the launch tube to an applied pressure level sufficient to cause the self-destructible valve to collapse and provide an opening of launch tube.

8. The apparatus for launching projectiles of claim 1, wherein the fast acting frontal valve comprises an inertia heavy lid that withstands a fast pressure buildup in the inner volume of the launch tube; wherein the fast acting frontal valve will be self opened when a pressure inside the launch tube reaches a predetermined pressure over a predetermined period of time.

9. The apparatus for launching projectiles of claim 1, wherein stationary, foldable, controllable aerodynamic stabilizers are mounted on an outer surface of the projectile.

10. The apparatus for launching projectiles of claim 1, wherein exhaust nozzle stabilizers are coupled to the launch tube.

11. The apparatus for launching projectiles of claim 1, wherein the launch tube further comprises a heating element that heats the compressed gas.

12. The apparatus for launching projectiles of claim 1, wherein the launch tube further comprises an evaporator and the compressed gas for pressurizing the launch tube is used in combination with a liquid to increase internal pressure within the launch tube.

13. The apparatus for launching projectiles of claim 1, wherein a head end of the projectile protrudes through the fast acting frontal valve; wherein the head end portion of the projectile comprises a socket to attach to a payload.

* * * * *